United States Patent [19]

Iwaoka et al.

[11] 4,168,158

[45] Sep. 18, 1979

[54] METHOD FOR PRODUCING ALLOY STEELS HAVING A HIGH CHROMIUM CONTENT AND AN EXTREMELY LOW CARBON CONTENT

[75] Inventors: Shoji Iwaoka; Takashi Ohtani, both of Ashiya; Hiroyuki Kaito, Takarazuka, all of Japan

[73] Assignee: Kawasaki Steel Corporation, Kobe Japan

[21] Appl. No.: 858,885

[22] Filed: Dec. 8, 1977

[51] Int. Cl.[2] ..... C21C 5/32; C21C 5/34; C22C 33/04

[52] U.S. Cl. ..... 75/60; 75/130.5

[58] Field of Search ..... 75/60, 130.5

[56] References Cited

U.S. PATENT DOCUMENTS

| | | | |
|---|---|---|---|
| 3,695,946 | 10/1972 | Demeaux | 75/49 |
| 3,751,242 | 8/1973 | Knuppel | 75/49 |
| 3,850,617 | 11/1974 | Umowski | 75/49 |
| 3,854,932 | 12/1974 | Bishop | 75/49 |

*Primary Examiner*—P. D. Rosenberg

[57] ABSTRACT

An alloy steel having a high chromium content and an extremely low carbon content is produced by soft blowing oxygen gas under vacuum into a molten steel in a ladle containing a high chromium content and a high carbon content while blowing an inert gas of a flowing rate of 1–15 Nl/min per ton of the molten steel into the molten steel until the carbon content in the molten steel becomes 0.025–0.050% by weight. And subsequently only the blowing of the inert gas is conducted into the molten steel under a high vacuum degree of less than 10 torr so that the reaction active area ratio becomes more than 7% to reduce the carbon content in the steel to less than 0.003%.

4 Claims, 1 Drawing Figure

Figure 1:
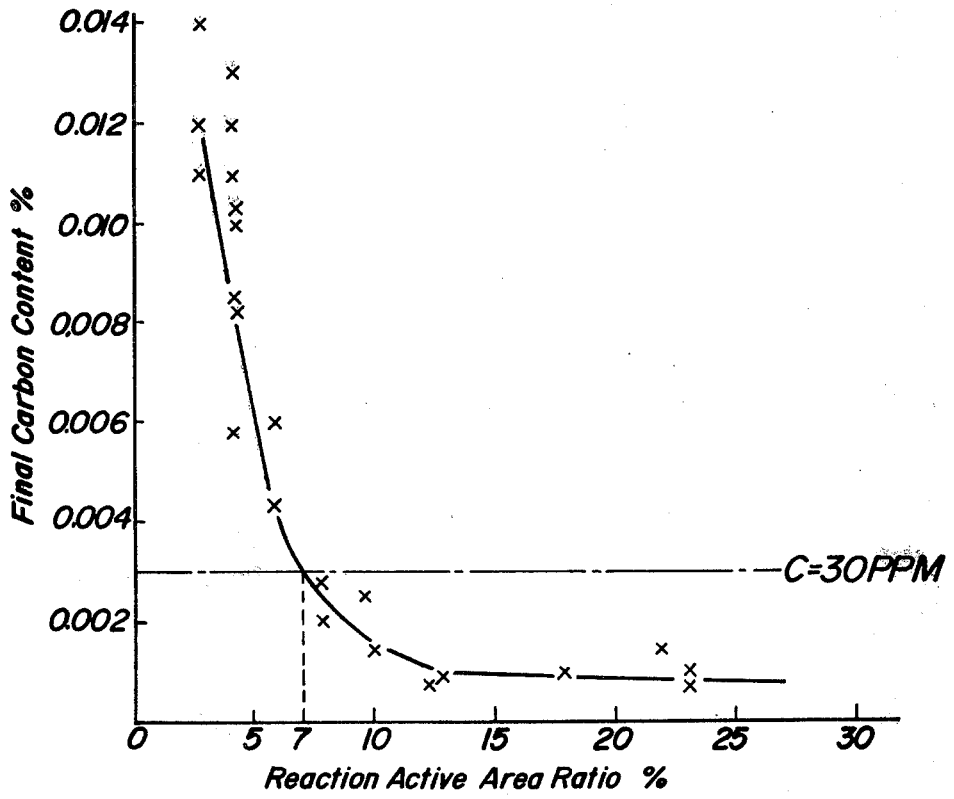

METHOD FOR PRODUCING ALLOY STEELS HAVING A HIGH CHROMIUM CONTENT AND AN EXTREMELY LOW CARBON CONTENT

The present invention relates to a method for producing alloy steels having a high chromium content and an extremely low carbon content.

It has been being found by the latest studies concerning ferritic stainless steels that the pitting corrosion resistance, the grain boundary corrosion resistance, the stress corrosion crack resistance and the toughness are noticeably improved by reducing the carbon content in the steel to less than 0.003% by weight. The percent (%) of the components in the steels means "by weight" hereinafter. Furthermore, concerning also austenitic stainless steel, an improving effect on the qualities is expected and the effect due to the extreme reduction of carbon content also can be expected with respect to the high alloy steels other than stainless steels and the development and studies have been being advanced in such a view point.

However, the method for producing such high alloy steels having an extremely low carbon content must rely upon the specific facilities, such as the electron beam melting process of AIRCO VACUUM METALS CO., the other vacuum induction melting process (SHOWA DENKO CO. LTD.) and the like and the process which can conduct the mass production with a reduced cost has never been yet established.

By the former process, E-Brite (26% Cr, 1% Mo steel, [C]: 0.002%) is produced and by the latter process, Shomac 302 (30% Cr, 2% Mo steel, [C]: 0.003%) is produced respectively but in any process, as for the charge material, charge must be made of the materials such as ferroalloy, scraps having an extremely low carbon content. The primary charge material, such as chromium alloy having a high carbon content, which is usually used for melting of stainless steel cannot be used, so that the production cost becomes noticeably high.

On the contrary, concerning the method for producing steels having an extremely low carbon content of less than 0.02% in which a decarburizing facilities under vacuum has been used, Japanese Patent Application Publication No. 4,602/75 discloses a vacuum decarburization practice by oxygen and Ar gas blowing into the molten steel in a ladle via a lance and a porous plug, respectively. But this process cannot be applied to the decarburization practice of a chromium bearing molten steels provided from a primary refining facilities such as conventional electric arc furnace or basic oxygen blowing converter for the reduction of carbon content to an extremely low level of less than 0.002%. Generally this molten steel has chromium content of more than 10% due to the charge of high carbon ferrochromium which is used in many cases as the primary charge material of stainless steel and other alloy steel. In the above said process preliminary partial decarburization is carried out, if necessary, prior to the vacuum decarburization.

Because, in this case, chromium is contained in the molten steel in a high content, so that when the decarburization is positively carried out by a hard blow process, $Cr_2O_3$ is preferentially formed and the formed $Cr_2O_3$ covers the molten steel surface, which presents CO reaction site and the effective decarburization reaction is retarded. Furthermore, when this oxygen blowing is continued to the chromium molten steel in which the carbon content is reduced to 0.01–0.02% even after exchanging the oxygen blow rate to a soft blow of 2–12 $Nm^3$/hr per ton of the molten steel, chromium in the steel is oxidized into $Cr_2O_3$ and the decarburization reaction is considerably deteriorated. According to the inventors' experiment, the fluidity of the slag becomes very diminished at $\Delta Cr = 0.45–1.00\%$ and the limitation of decarburization is only about 0.005–0.0072% and it has been impossible to reduce the carbon content to less than 0.003% which is aimed in the present invention.

Thus, any of the above described conventional processes are insuitable for the practical steel making means and the replacement by the vacuum decarburization for this means has not been suitable, when the chromium content in the molten steel is high, because of the high affinity of chromium to oxygen, the vacuum decarburization is not applicable when a ferroalloy having an extremely low carbon of less than 0.003% is produced by using the primary molten steel containing a much larger content of Cr than C.

The inventors have made studies with respect to the vacuum decarburization of a high chromium steel in which the preferential formation reaction of $Cr_2O_3$ is advantageously restrained and the carbon content is reduced to an extremely low content of less than 0.003%.

An object of the present invention is to provide a method for producing steels having a high chromium content and an extremely low carbon content economically and conventionally in a mass production system by subjecting molten steels having a high chromium content and a high carbon content using ferrochromium having a high carbon content, which is less expensive as the primary charge material of stainless steel and the other alloy steels.

It has been found that in the decarburization refining of a molten steel containing 0.2–1.0% of C, less than 0.6% of Si, more than 10% of Cr and the other necessary alloy components in a ladle under vacuum, if oxygen gas is blown to the surface of the molten steel in a soft blow manner until the carbon content in the steel becomes 0.25–0.05% while blowing an inert gas into the molten steel through porous plugs provided at the bottom of the ladle, the decarburization reaction can be attained without forming $Cr_2O_3$ in spite of a high content of chromium.

Unless the carbon content at the termination of oxygen blowing is rendered to be more than 0.025%, even in the soft blowing, the surface of the molten steel is covered with a low fluidable slag containing much of $Cr_2O_3$ and the subsequent reaction is retarded.

In the present invention, in order to effectively restrain the formation of $Cr_2O_3$ which impairs the fluidity of slag due to oxidation of Cr in the steel, the oxygen gas is soft blown and the soft blow is terminated until the carbon content in the steel reaches 0.025–0.05%, and the blowing temperature of the molten steel bath is higher than 1,670° C. The flow rate of the refining oxygen is 1–20 $Nm^3$/hr, preferably 1–11.5 $Nm^3$/hr per ton of the molten steel and the distance of the blowing lance from the surface of the molten steel bath is preferably 500–1,500 mm. The flow rate of the inert gas for promoting the stirring of the molten steel upon the vacuum decarburization is 1–15 Nl/min per ton of the molten steel, preferably 5–15 Nl/min and for example it is preferable to blow the inert gas from the bottom of the ladle through the porous plugs.

The inert gas must be 1 Nl/min, preferably 5 Nl/min per ton of the molten steel in order to adjust the decarburization efficiency economically, and the upper limit of 15 Nl/min is one for avoiding the erosion loss of the porous plugs during refining which progresses under a relatively high temperature. The vacuum degree in this step is less than 40 torr and the refining temperature is preferably 1,670°-1,720° C.

The above mentioned treatment is designated as the first step of the present invention and when the decarburization proceeds to 0.025-0.05% of C by this step, the blowing of oxygen gas is terminated and successively the decarburization reaction shown by the following formula under a high vacuum of less than 10 torr is continued while stirring the molten steel by blowing the increased rate of the inert gas through the porous plugs above mentioned treatment is designated as the second step.

$$[C]+[O]=CO(g)$$

In this case, it is necessary that an inert gas is blown into the molten steel, so that the reaction active area ratio given by the percentage of the surface renewing area owing to the blowing gas based on the surface area of the molten steel bath becomes more than 7% and in order to make the reaction active surface area ratio to be more than 7%, the rate of the inert gas blown needs at least 6 Nl/min per ton of the molten steel and in addition, said ratio can be attained by appropriately setting the number of the porous plugs and the location of the porous plugs. Furthermore, when the flow rate of the inert gas exceeds 40 Nl/min per ton of the molten steel, a problem in view of operation occurs due to the vigorous splash scattering.

"The reaction active surface area ratio" used herein means the followings. The total surface area of the molten steel in the ladle is referred to as "S" and the areas at the surface of the molten steel in the ladle which are renewed by the bubbling owing to the inert gas blown through porous plugs provided at the bottom of the ladle, are referred to as $a_1, a_2, a_3 \ldots a_n$ respectively.

Reaction active surface area ratio =

$$\frac{a_1 + a_2 + a_3 + \ldots + a_n}{S} \times 100$$

The vacuum degree of 10 torr can be easily ensured by the exhaust installation such as a steam ejector system which is applied to the conventional vacuum decarburization facilities.

The above described reaction in the second step utilizes an optimum amount of $SiO_2$ having a good fluidity as an oxygen source as well as [O] contained in the steel and in this case, it is merely necessary that [Si] amount in the molten steel prior to starting of the first step is less than 0.6%. This content of Si is determined from the limit of the erosion damage of refractories in order to conducted the operation safe. The refining temperature in the second step is preferred to be in the range of 1,560°-1,720° C.

As mentioned above, the present invention can advantageously accomplish the decarburization to less than 0.003% by applying the vacuum decarburizing process to a molten high chromium steel.

The present invention will be explained in more detail.

For a better understanding of the invention, reference is taken to the accompanying drawing, wherein:

FIG. 1 is a graph showing the influence of the reaction active area ratio upon the finally attained carbon content [C]%.

The following examples are given for the purpose of illustration of this invention and are not intended as limitations thereof.

EXAMPLE 1

By using a vacuum ladle decarburization facilities, while blowing 5.5 Nl/min per ton of molten steel of argon gas into 52 ton of molten steel containing 0.60% of C, 0.30% of Si, 0.37% of Mn, 18.16% of Cr and 2.27% of Mo through porous plugs provided at the bottom of the ladle, oxygen gas was blown to the surface of the molten steel in a flow rate of 16 $Nm^3$/hr per ton of molten steel under a vacuum degree of 6-40 torr to conduct decarburization until the carbon content in the steel became 0.032%. In this case, the main chemical components of the molten steel were 0.09% of Si, 0.31% of Mn, 17.89% of Cr, 2.28% of Mo and 0.060% of O and the temperature of the molten steel in the ladle was 1,700° C.

Then, the flow rate of blowing argon gas through the porous plugs was increased to 9.6 Nl/min per ton of the molten steel and the decarburization reaction was continued under a high vacuum degree of 0.5-1.0 torr at the reaction active area ratio of 17.7% for 40 minutes to refine the molten steel and to obtain the molten steel having the following composition.

C: 0.0025%, Si: 0.10%, Mn: 0.28%, Cr: 17.80%, Mo: 2.26%, O: 0.0305%, Temperature: 1,610° C.

EXAMPLE 2

By using the same vacuum ladle decarburization facilities as in Example 1, oxygen gas was blown into 52 tons of molten steel containing 0.55% of C, 0.50% of Si, 0.48% of Mn, 18.56% of Cr and 2.12% of Mo in a flow amount of 11 $Nm^3$/hr per ton of the molten steel under a vacuum degree of 6-40 torr while blowing 8.4 Nl/min of argon gas per ton of the molten steel through porous plugs provided at the bottom of the ladle and the decarburization was conducted until the carbon content in the steel became 0.0310%. In this case the main chemical components were 0.13% of Si, 0.39% of Mn, 18.41% of Cr, 2.13% of Mo and 0.052% of O and the temperature of the molten steel was 1,690° C.

Successively, the flow rate of blowing argon gas was increased to 12.5 Nl/min per ton of the molten steel and the decarburization reaction was continued under a high vacuum of 0.5-1.0 torr at the reaction active area ratio of 23.0% for 40 minutes to refine the molten steel and to obtain the molten steel having the following composition.

C: 0.0008%, Si: 0.14%, Mn: 0.25%, Cr: 18.35%, Mo: 2.12%, O: 0.0295%, The temperature: 1,625° C.

Other than the above described examples, a large number of experiments have been carried out and concerning the blowing of the inert gas in the second step, the relation between the reaction active area ratio and the finally obtained carbon content [C]% was correlated and the result as shown in FIG. 1 was obtained. As the result, it can be seen that such a flow rate of blowing the inert gas as achieving the reaction active area ratio more than 7% is necessary for the achievement of the present invention.

Thus, according to the present invention, the carbon content of the alloy steel having a high chromium content can be easily reduced to a considerably low content of less than 0.003% only by using a conventional vacuum decarburizing equipment without installing any special facilities. Furthermore not only the profound productivity increase of the alloy steel having a high chromium content and an extremely low carbon content as well as stainless steel but also the remarkable cost reduction and the quality improvement are performed.

The present invention is applicable to alloy steels production containing alloy components which do not influence or give a few influence upon the decarburization reaction in the vacuum decarburization installation.

What is claimed is:

1. A method for producing alloy steels having a high chromium content and an extremely low carbon content in which a molten steel containing 0.2–1.0% by weight of C, less than 0.6% by weight of Si, and more than 10% by weight of Cr is decarburized and refined under vacuum in a ladle, which comprises (a) a first step for blowing oxygen gas at a blowing rate of 1–20 $Nm^3$/hr per ton of the molten steel to a surface of the molten steel at a distance of lance blown from the surface of the molten steel being 500–1,500 mm until a carbon content in the steel becomes 0.025–0.050% by weight while blowing a flow amount of 1–15 Nl/min per ton of the molten steel of an inert gas into the molten steel from bottom of the ladle and (b) a second step for continuing only the blowing of the inert gas from the bottom of the ladle under a high vacuum of less than 10 torr so that a reaction active area ratio given by a percentage of a surface renewing area owing to the blowing inert gas per the surface area of the molten bath becomes more than 7%, to reduce the carbon content in the molten steel to less than 0.003%.

2. The method as claimed in claim 1, wherein an amount of oxygen blown in the first step is 1–20 $Nm^3$/hr per ton of the molten steel and a distance of lance blown from the surface of the molten steel is 500–1,500 mm.

3. The method as claimed in claim 2, wherein the amount of oxygen blown is 1–11.5 $Nm^3$/hr.

4. The method as claimed in claim 1, wherein the amount of the inert gas blown is 5–15 Nl/min per ton of the molten steel.

* * * * *